US010147383B2

(12) United States Patent
Kim et al.

(10) Patent No.: US 10,147,383 B2
(45) Date of Patent: Dec. 4, 2018

(54) DISPLAY DEVICE USING POWER SYNC SIGNAL TO CONSERVE POWER AND OPERATING METHOD FOR THE SAME

(71) Applicant: SAMSUNG ELECTRONICS CO., LTD., Suwon-si, Gyeonggi-do (KR)

(72) Inventors: Tae-hoon Kim, Suwon-si (KR); Tae-hyeun Ha, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 191 days.

(21) Appl. No.: 15/055,799

(22) Filed: Feb. 29, 2016

(65) Prior Publication Data

US 2016/0300543 A1 Oct. 13, 2016

(30) Foreign Application Priority Data

Apr. 7, 2015 (KR) ..... 10-2015-0049073

(51) Int. Cl.

| | |
|---|---|
| ***G09G 3/36*** | (2006.01) |
| ***G09G 3/34*** | (2006.01) |
| ***G09G 3/3233*** | (2016.01) |

(52) U.S. Cl.

CPC ..... *G09G 3/3696* (2013.01); *G09G 3/3233* (2013.01); *G09G 3/3406* (2013.01); *G09G 3/3648* (2013.01); *G09G 2330/021* (2013.01); *G09G 2330/022* (2013.01)

(58) Field of Classification Search

CPC ..... G09G 2330/00

See application file for complete search history.

(56) References Cited

U.S. PATENT DOCUMENTS

| | | | |
|---|---|---|---|
| 5,862,437 | A | 1/1999 | Kutsuwada et al. |
| 6,233,162 | B1 | 5/2001 | Pistemaa et al. |
| 7,683,898 | B2 | 3/2010 | Park et al. |
| 8,421,718 | B2 | 4/2013 | Kim et al. |
| 9,013,465 | B2 | 4/2015 | Chung |

(Continued)

FOREIGN PATENT DOCUMENTS

| | | |
|---|---|---|
| JP | 3658055 | 6/2005 |
| JP | 4555063 | 9/2010 |

(Continued)

OTHER PUBLICATIONS

Partial European Search Report dated Jun. 15, 2016 in counterpart European Patent Application No. 16157670.7.

(Continued)

*Primary Examiner* — Sanghyuk Park

(74) *Attorney, Agent, or Firm* — Nixon & Vanderhye P.C.

(57) ABSTRACT

A display device including a display panel is provided, the display device including a plurality of pixels, a display controller configured to input image data to the plurality of pixels during a second time within a first time, the first time being determined by a scanning frequency of the display panel and to maintain the image data input to the plurality of pixels during a third time, the third time being a part or all of the first time excluding the second time, and a power supply configured to supply power to the display panel and the display controller. The display controller generates a power sync signal which is enabled during the second time, and the power supply supplies the power based on the power sync signal.

14 Claims, 6 Drawing Sheets

(56) References Cited

U.S. PATENT DOCUMENTS

| | | | | |
|---|---|---|---|---|
| 2002/0036636 | A1* | 3/2002 | Yanagi | G09G 3/3696 345/211 |
| 2002/0044116 | A1 | 4/2002 | Tagawa et al. | |
| 2002/0060660 | A1 | 5/2002 | Yamasaki | |
| 2004/0140972 | A1 | 7/2004 | Hirota et al. | |
| 2007/0132710 | A1* | 6/2007 | Tateuchi | G06F 1/3203 345/102 |
| 2010/0128022 | A1 | 5/2010 | Takada et al. | |
| 2011/0022867 | A1* | 1/2011 | Chang | G06F 1/3218 713/323 |
| 2013/0114313 | A1 | 5/2013 | Jung | |
| 2015/0035737 | A1 | 2/2015 | Takatori et al. | |

FOREIGN PATENT DOCUMENTS

| | | |
|---|---|---|
| KR | 10-0422595 | 3/2004 |
| KR | 10-0438786 | 6/2004 |
| KR | 10-2005-0049179 | 5/2005 |
| KR | 10-0744508 | 7/2007 |
| KR | 10-2012-0079364 | 7/2012 |
| KR | 10-1365856 | 2/2014 |

OTHER PUBLICATIONS

Extended European Search Report dated Jul. 12, 2016 in counterpart European Patent Application No. 16157670.7.
EP Oral Proceedings/Written Submission for EP Application No. 16 157 670.7 dated Jun. 11, 2018.

* cited by examiner

DISPLAY DEVICE USING POWER SYNC SIGNAL TO CONSERVE POWER AND OPERATING METHOD FOR THE SAME

CROSS-REFERENCE TO RELATED APPLICATION

This application is based on and claims priority under 35 U.S.C. § 119 to Korean Patent Application No. 10-2015-0049073, filed on Apr. 7, 2015, in the Korean Intellectual Property Office, the disclosure of which is incorporated by reference herein in its entirety.

BACKGROUND

1. Field

The present disclosure relates generally to a display device and an operating method for the same, and for example, to a display device whose power supply efficiency may be improved and an operating method for the display device.

2. Description of Related Art

Electric power necessary to drive a display device varies according to a frame rate, a brightness of the display, an aperture ratio of the display, a size of the display, a driven display region, and so on. While the aperture ratio of the display and the size of the display are determined in advance when the display is designed, other elements may vary according to a display method.

Meanwhile, a power supply that supplies power to the display is designed to supply a highest power necessary to drive the display. Here, the power supply is designed to achieve optimal efficiency according to a highest power supply state or a highest power consumption state. Accordingly, power supply efficiency of the power supply being lowered is a problem when low power is consumed to drive the display, such as when the display is driven at a low frame rate, when the display is driven with lowest brightness, when only a part of the display is driven, or the like.

SUMMARY

A display device whose power supply efficiency may be improved while the display device operates with low power, and an operating method for the display device are provided.

Additional aspects will be set forth in part in the description which follows and, in part, will be apparent from the description.

According to an aspect of an example embodiment, a display device includes a display panel including a plurality of pixels, a display controller configured to input image data to the plurality of pixels during a second time, the second time being within a first time, the first time being determined by a scanning frequency of the display panel, and to maintain the image data input to the plurality of pixels during a third time, the third time being part or all of the first time excluding the second time, and a power supply configured to supply power to the display panel and the display controller. The display controller generates a power sync signal which is enabled during the second time, and the power supply supplies power to the display panel based on the power sync signal.

The power supply may include a switching mode power supply (SMPS).

The power supply may be configured to perform switching to supply the power when the power sync signal is enabled, and may be configured to stop the switching when the power sync signal is disabled.

A voltage of the power may increase to a preset voltage when the switching is performed, and gradually decrease when the switching is stopped.

The display device may further include a backlight unit configured to emit light to the display panel, and the backlight unit may be configured to emit the light when the power sync signal is enabled.

The display device may consume a first power consumption during the second time, and consume a second power consumption during the third time, the second power consumption being lower than the first power consumption.

Each of the first power consumption and the second power consumption may be lower than a highest power consumption of the display device.

According to another aspect of another example embodiment, a method for operating a display device includes inputting image data to each of a plurality of pixels included in a display panel during a second time, the second time being within a first time, the first time being determined by a scanning frequency of the display panel, and maintaining the image data input to each of the plurality of pixels during a third time, the third time being part or all of the first time excluding the second time, generating a power sync signal which is enabled during the second time, and supplying power to the display panel and a display controller based on the power sync signal.

The supplying of the power to the display panel and the display controller based on the power sync signal may include performing switching to supply the power when the power sync signal is enabled, and stopping the switching when the power sync signal is disabled.

The operating method for the display device may further include emitting light to the display panel when the power sync signal is enabled.

The operating method for the display device may further include consuming a first power consumption during the second time, and consuming a second power consumption which is lower than the first power consumption during the third time.

BRIEF DESCRIPTION OF THE DRAWINGS

These and/or other aspects will become apparent and more readily appreciated from the following detailed description, taken in conjunction with the accompanying drawings, in which like reference numerals refer to like elements, and wherein.

DETAILED DESCRIPTION

Figure 1:
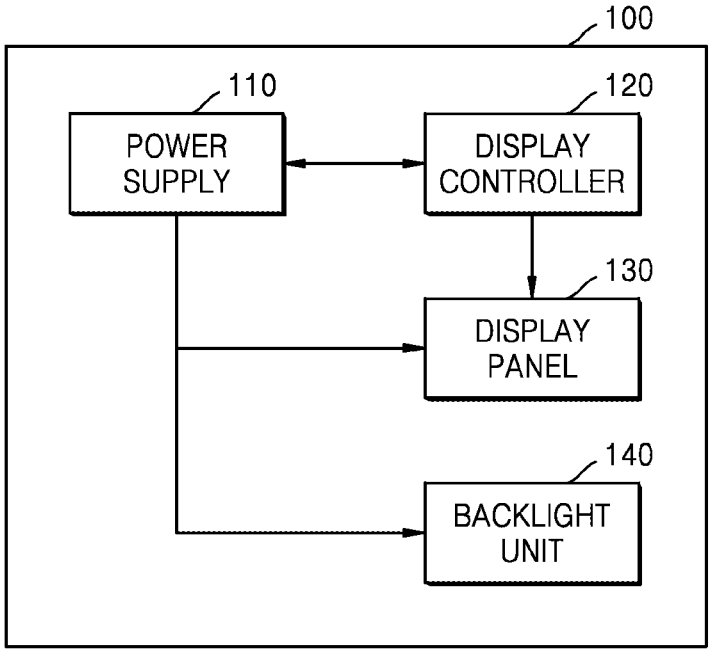
FIG. 1 is a block diagram illustrating an example configuration of a display device.

Terminology used in this disclosure will be described in brief, and then the present disclosure will be described in greater detail with reference to the drawings.

As terminology used herein, general terms currently in wide use are selected wherever possible in consideration of functions in the present disclosure, but may vary based on intentions of those of ordinary skill in the art, precedent cases, the advent of new technology, and so on. For example, some terms may be arbitrarily selected, and in such cases, the detailed meanings of the terms will be stated in the corresponding description. Therefore, the terms used in this disclosure should be defined based on the meanings of the terms together with the description throughout the disclosure rather than their simple names.

Throughout the disclosure, when a portion "includes" an element, unless otherwise described, another element may be further included, rather than the presence of other elements being excluded. Also, terms such as "unit," "module," etc. used herein represent elements that process at least one function or operation, and may be implemented as hardware (e.g., circuitry), firmware, software, or a combination of hardware and software.

Reference will now be made in detail to example embodiments, examples of which are illustrated in the accompanying drawings, wherein like reference numerals refer to like elements throughout. In this regard, the present example embodiments may have different forms and should not be construed as being limited to the descriptions set forth herein. Accordingly, the example embodiments are simply described below, by referring to the figures, to explain aspects of the present disclosure.

FIG. 1 is a block diagram illustrating an example configuration of a display device.

A display device 100 according to an example embodiment may include a power supply 110, a display controller 120, a display panel 130, and a backlight unit 140.

The power supply 110 supplies power input from an external power source to internal components of the display device 100. For example, to display a video, the power may be supplied to the display controller 120, the display panel 130, and the backlight unit 140. Also, the power supply 110 may supply the internal components with power output from one or more batteries (not shown) present in the display device 100.

The power supply 110 according to an example embodiment may include a switching mode power supply (SMPS). The SMPS according to an example embodiment generates power in the following sequence. The SMPS converts an input alternating current (AC) voltage into a direct current (DC) voltage through, for example, a rectifier circuit or a smoothing circuit. The SMPS operates a semiconductor switch, such as a metal-oxide-semiconductor field-effect transistor (MOSFET), etc., using the DC voltage, thereby generating induced electromotive force in a primary coil of a transformer. The induced electromotive force generated in the primary coil of the transformer generates a fixed AC voltage based on a turn ratio of the primary coil and the secondary coil. The generated AC voltage is converted into DC power through a secondary rectifier diode and an output capacitor.

By switching switches included in the power supply 110, the power supply 110 may generate the power which is supplied to the display controller 120, the display panel 130, and the backlight unit 140. Also, the power supply 110 may include the output capacitor, and even when switching is stopped, a voltage (output voltage) of the power supplied from the power supply 110 gradually decreases due to the output capacitor.

The display controller 120 and the display panel 130 will be described in greater detail below with reference to FIGS. 2 and 3.

Figure 2:
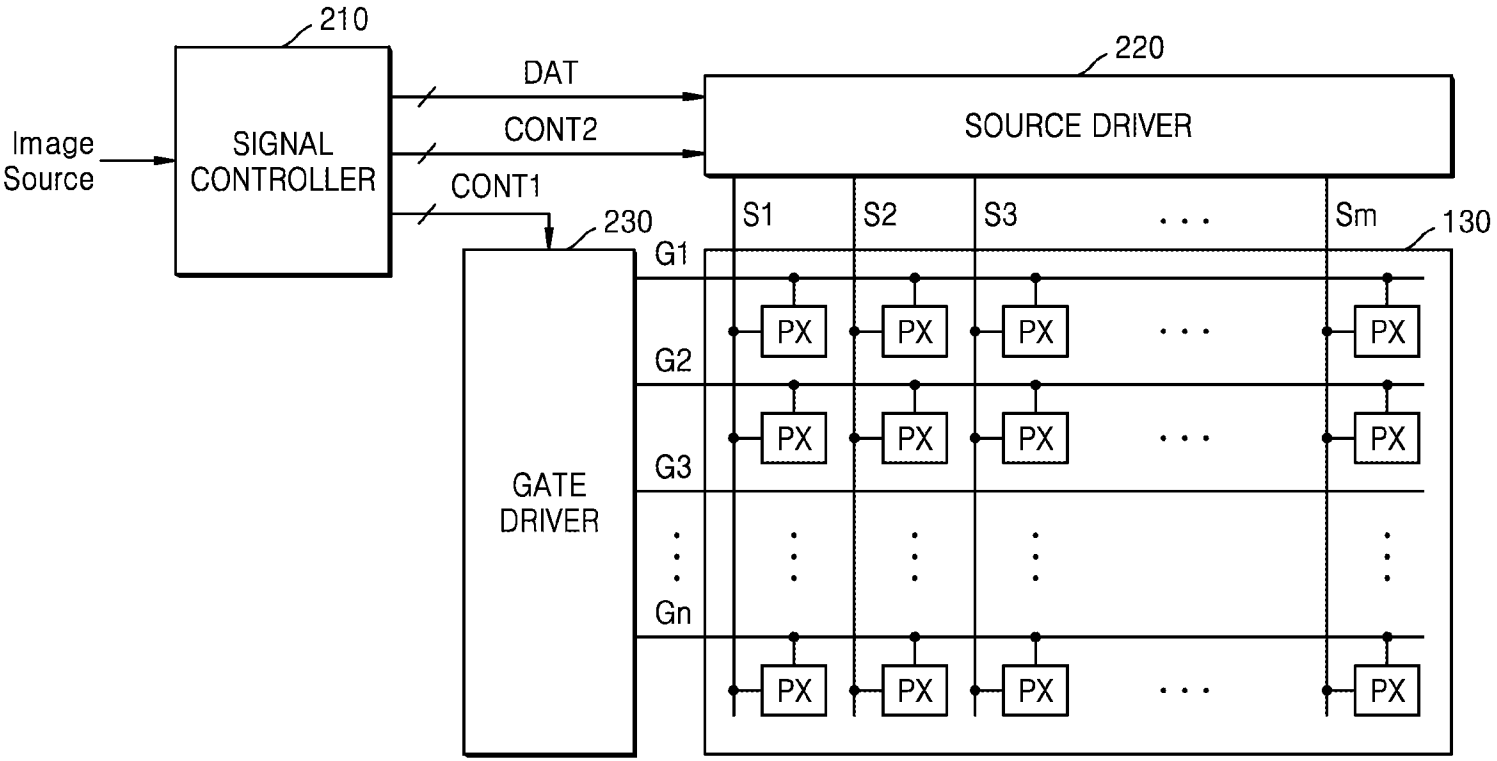
FIG. 2 is a diagram illustrating example internal configurations of a display controller and a display panel of FIG. 1.
Figure 3:
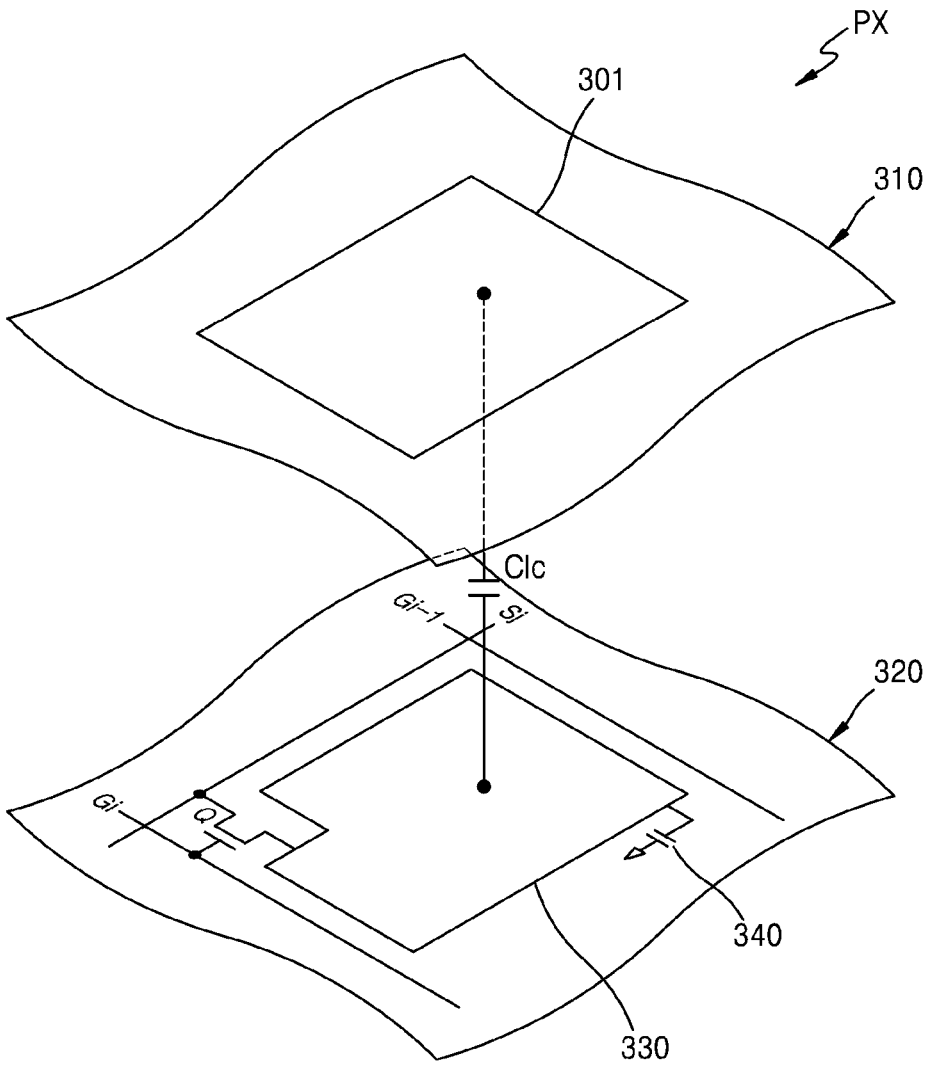
FIG. 3 is a diagram illustrating an equivalent circuit of one pixel.

FIG. 2 is a diagram illustrating example internal configurations of the display controller 120 and the display panel 130 of FIG. 1, and FIG. 3 is a diagram illustrating an equivalent circuit of one pixel.

Referring to FIG. 2, the display controller 120 may include a signal controller 210, a source driver 220, and a gate driver 230.

The signal controller 210 may receive an image source from an external device, or a video processor (not shown) or a storage in the display device 100. The signal controller 210 may be configured to generate image data DAT, a gate control signal CONT1, and a source control signal CONT2 based on the received image source and an operating condition of the display panel 130, and output, for example, the image data DAT to the source driver 220, the gate control signal CONT1 to the gate driver 230, and the source control signal CONT2 to the source driver 220.

The display panel 130 according to an example embodiment may include a liquid crystal display (LCD) panel. The LCD panel may include upper and lower display plates 310 and 320 facing each other, and a liquid crystal layer interposed between the upper and lower display plates 310 and 320. Also, the LCD panel includes a plurality of gate lines G1 to Gn and a plurality of source lines S1 to Sm. The plurality of gate lines G1 to Gn extend, for example, in a horizontal direction, and the plurality of source lines S1 to Sm extend, for example, in a vertical direction while crossing the plurality of gate lines G1 to Gn. One gate line and one source line are connected to one pixel. Such pixels are arranged in a matrix form.

Referring to FIG. 3, each pixel PX may include a thin film transistor (TFT) Q, a liquid crystal capacitor Clc, and a holding capacitor 340. A control terminal of the TFT Q may be connected to one gate line Gi, an input terminal of the TFT Q may be connected to one source line Sj, and an output terminal of the TFT Q may be connected to a pixel electrode 330, which is one terminal of the liquid crystal capacitor Clc, and one terminal of the holding capacitor 340. The other terminal of the liquid crystal capacitor Clc may be connected to a common electrode 301 disposed, for example, on the upper plate 310. The display controller 120 may control the TFT Q to reset the holding capacitor 340 and to recharge the holding capacitor 340, thereby inputting new image data to each pixel.

The display controller 120 according to an example embodiment may input image data to each of the plurality of pixels included in the display panel 130 during a second time within a first time, the first time being determined by a scanning frequency of the display panel 130. For example, the first time may, for example, be a time corresponding to a scanning period determined by the scanning frequency of the display panel 130. For example, when the scanning frequency of the display panel 130 is about 60 Hz, the first time corresponding to the scanning period may be about 16.6 ms. When the first time is about 16.6 ms, the second time is shorter than the first time and may, for example, be about 8.8 ms or about 4.4 ms. Accordingly, when the scanning frequency of the display panel 130 is about 60 Hz, the display controller 120 may be configured to provide control so that image data is sequentially input to each of the plurality of pixels included in the display panel 130 for about 8.8 ms or about 4.4 ms.

When the image data is input to each of the plurality of pixels, the display controller 120 may be configured so that the image data input to each of the plurality of pixels is held during a third time which is, for example, all or part of the first time excluding the second time. For example, when the first time is about 16.6 ms and the second time is about 4.4 ms, the third time may be about 12.2 ms, and the display controller 120 may hold the image data input to each of all the pixels for about 12.2 ms.

During a time in which the image data is input to each of the plurality of pixels, the display device 100 may operate with the highest power consumption, and during a time in which the image data input to each of the plurality of pixels is held, the display device 100 may operate with the lowest power consumption.

Accordingly, the display controller 120 may generate a power sync signal which is enabled during the second time in which the image data is input, and transmit the power sync signal to the power supply 110. An enable signal may be a high-level signal, and a disable signal may be a low-level signal.

The power supply 110 according to an example embodiment may supply the power based on the power sync signal. For example, the power supply 110 may switch the switches included therein when the power sync signal is enabled, and may stop switching when the power sync signal is disabled.

Meanwhile, the backlight unit 140 refers, for example, to a light source device that emits light from a rear side of the display panel 130. Liquid crystal may not emit light by itself, and thus the display panel 130 may display a video only by receiving light emitted from the backlight unit 140. The light emitted from the backlight unit 140 is adjusted in transmittance and color through the display panel 130, and causes the video displayed on the LCD panel 130 to be viewable by a user. The backlight unit 140 may include light sources, such as thin-film cold cathode fluorescent lamps (CCFLs), light-emitting diodes (LEDs), etc., above and below or on left and right sides of the display panel 130, and may include a light guide plate so that the light emitted from the light source is evenly distributed to the display panel 130.

The display controller 120 according to an example embodiment may generate dimming data for controlling operation of the backlight unit 140 based on image data input to the display panel 130. The display controller 120 may transmit the generated dimming data to the power supply 110. By supplying the power to the backlight unit 140 based on the dimming data, the power supply 110 may operate the backlight unit 140. For example, the backlight unit 140 may be operated when the power sync signal is enabled.

Figure 4:
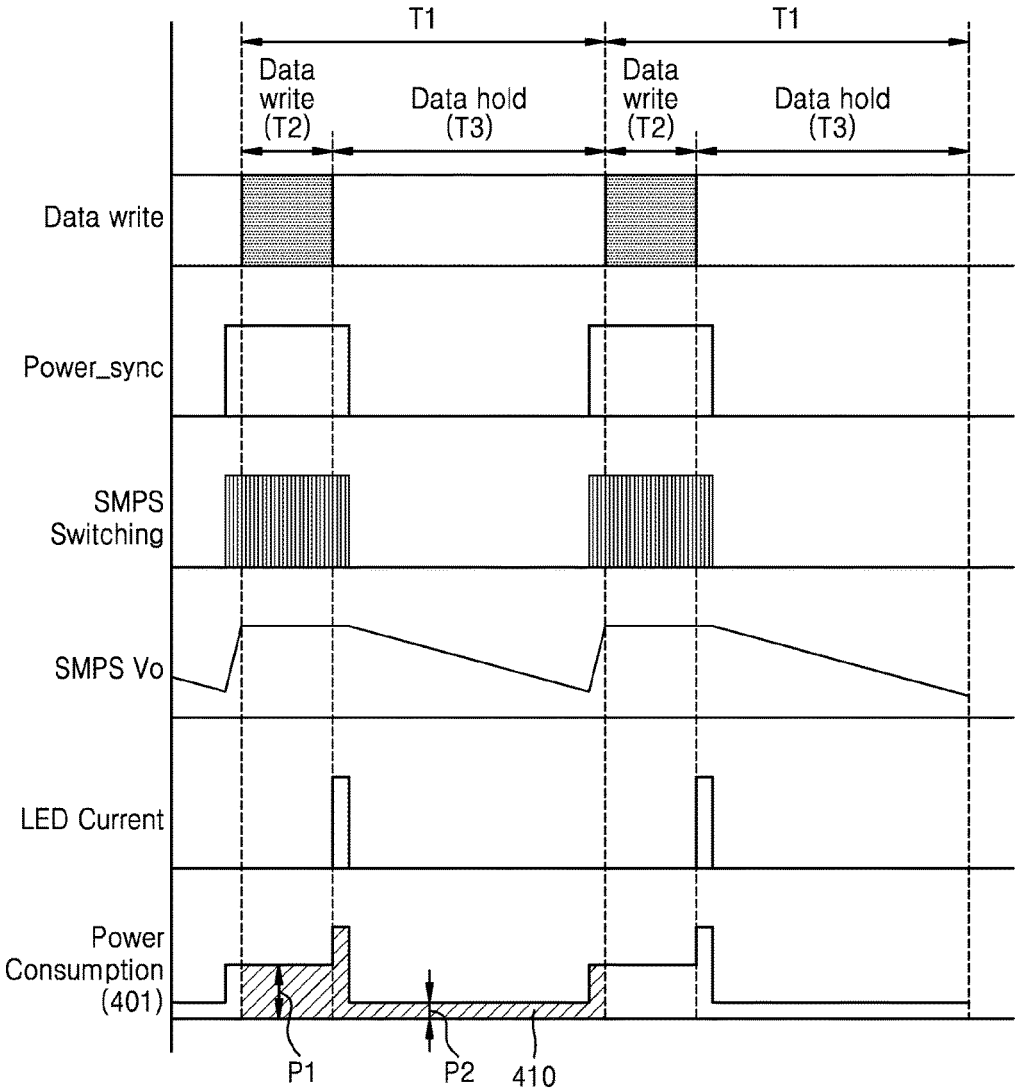
FIGS. 4 and 5 are timing diagrams illustrating an example operating method for the display device.
Figure 5:
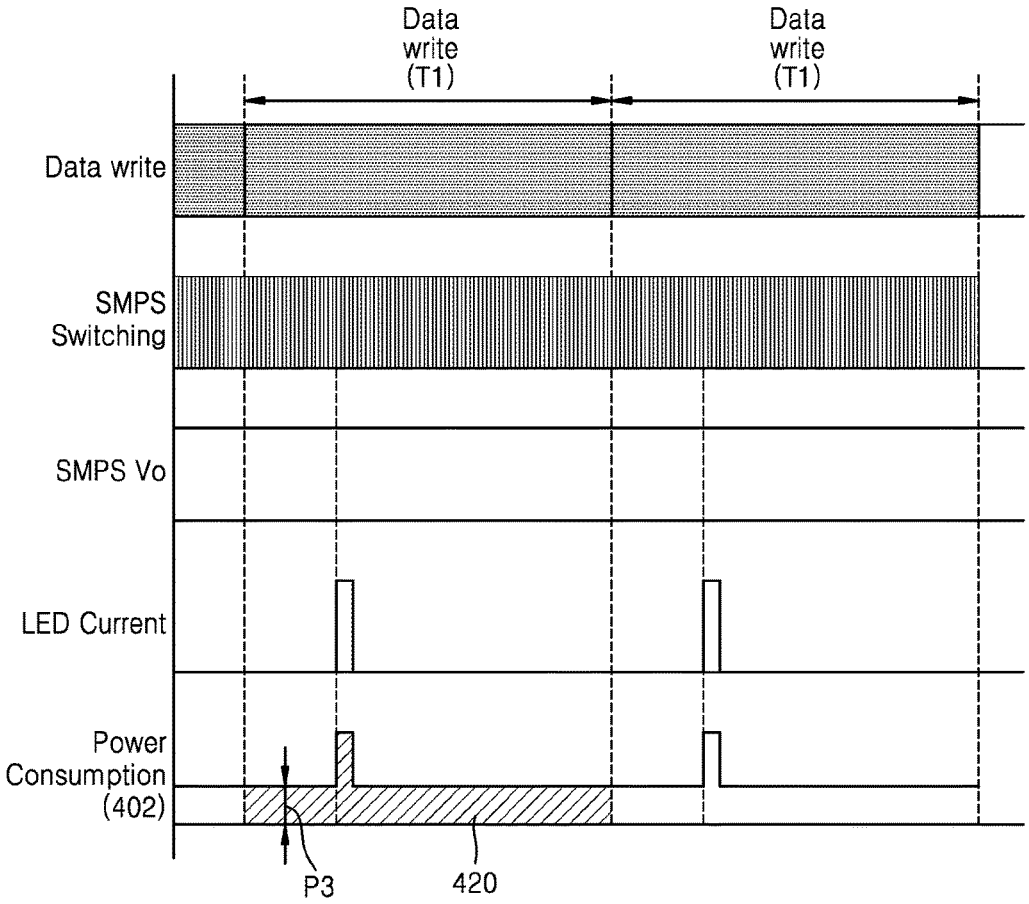

FIGS. 4 and 5 are diagrams illustrating an example operating method for a display device.

FIG. 4 is a timing diagram illustrating an example power sync signal, an example SMPS switching signal, an example SMPS output voltage, an example current signal of an LED included in a backlight unit, and an example power consumed by a display device.

Referring to FIG. 4, the display device 100 may sequentially input image data to each of the plurality of pixels included in the display panel 130 during a first time T1 determined by a scanning frequency of the display panel 130, and may maintain the data input to each of the plurality of pixels. For example, when a time corresponding to a scanning period determined by the scanning frequency is the first time T1, the display device 100 may sequentially input image data to the respective pixels included in the display panel 130 during a second time T2 within the first time T1 (Data write). Also, after the image data is input to each of the plurality of pixels, the display device 100 may maintain the data input to each of the plurality of pixels during a third time T3 which is all or a portion of the first time T1 excluding the second time T2 (Data hold). During the third time T3, the display device 100 does not perform an operation inputting image data to a pixel.

The display device 100 may, for example, operate with the highest power consumption during a time in which the image data is input to each of the plurality of pixels, and may operate with the lowest power consumption during a time in which the image data input to each of the plurality of pixels is maintained. Accordingly, as illustrated in FIG. 4, the display device 100 may generate a power sync signal Power_sync which is enabled during the time in which the image data is input, and the enabled signal may be a high-level signal.

The display device 100 may control switching of switches included in the power supply 110 (e.g., an SMPS) based on the power sync signal Power sync. For example, the display device 100 may switch the switches when the power sync signal Power_sync is enabled, and may stop switching when the power sync signal Power_sync is disabled.

Referring to FIG. 4, since the power supply 110 includes the output capacitor, when switching is performed, a voltage Vo of power supplied from the power supply 110 gradually increases up to a preset voltage and then is maintained at the preset voltage. Also, when the switching is stopped, the voltage Vo of the power gradually decreases. Therefore, it may be necessary to start switching before a time point at which input of image data is started so that the power voltage Vo supplied from the power supply 110 reaches the preset voltage at the time point at which input of the image data is started.

Therefore, the power sync signal Power_sync may be enabled at a time point before the time point at which input of the image data is started, and accordingly, the power supply 110 may start switching before the time point at which input of the image data is started.

Meanwhile, when the power sync signal Power_sync is enabled, the display device 100 may cause the backlight unit 140 to operate. For example, as illustrated in FIG. 4, the display device 100 may cause the backlight unit 140 to operate (e.g., by turning on the LED) at a certain time point in a time period in which the power sync signal Power_sync is enabled, thereby controlling the backlight unit 140 to emit light to the display panel 130. A user of the display device 100 may recognize an image input to the display panel 130 at a time point at which the backlight unit 140 operates.

A timing diagram 401 of power consumption (referred to as "first timing diagram" below) illustrated in FIG. 4 will be described below in comparison with a timing diagram 402 of power consumption (referred to as "second timing diagram" below) shown in FIG. 5.

FIG. 5 is a timing diagram of an example SMPS switching signal, an example SMPS output voltage, an example current signal of an LED included in a backlight unit, and example power consumed by a display device when image data is continuously input to each of a plurality of pixels in sequence during the first time T1 (a scanning period).

Referring to FIG. 5, during the first time T1, the display device 100 continuously inputs image data to each of the plurality of pixels in sequence, and thus SMPS switching is continuously performed. Accordingly, the voltage of supplied power may be maintained at the preset voltage. Also, at a certain time point, the backlight unit 140 may be operated (e.g., by turning on the LED) and emit light to the display panel 130.

The first timing diagram 401 illustrated in FIG. 4 and the second timing diagram 402 illustrated in FIG. 5 will be described in greater detail below in comparison with each other.

The first diagram 401 of FIG. 4 is a timing diagram of power consumed by the display device 100 when image data is sequentially input to each of the plurality of pixels included in the display panel 130 during the second time T2 within the first time T1 and the data input to each of the plurality of pixels is maintained during the third time T3 which is all or part of the remaining time in the first time T1. On the other hand, the second diagram 402 of FIG. 5 is a timing diagram of power consumed by the display device 100 when image data is continuously input to each of the plurality of pixels in sequence during the first time T1 (a scanning period).

For example, when the scanning frequency of the display panel 130 is about 60 Hz, the first diagram 401 of FIG. 4 is a timing diagram of power consumed by the display device 100 inputting image data for about 4.4 ms and maintaining the input image data for about 12.2 ms according to an example embodiment, and the second diagram 402 of FIG. 5 is a timing diagram of power consumed by the display device 100 inputting image data for about 16.6 ms.

Referring to the first timing diagram 401, in a period excluding a time point at which the backlight unit 140 is operated, the display device 100 consumes a first power consumption P1 during the second time T2 in which image data is input, and consumes a second power consumption P2, which is lower than the first power consumption P1, during the third time T3 in which the image data is maintained. On the other hand, referring to the second timing diagram 402, the display device 100 continuously consumes a fixed third power consumption P3 during the first time T1 (a scanning period).

Assuming that electric energy 410 consumed during one period (the first time T1) in the first timing diagram 401 and electric energy 420 consumed during one period (the first time T1) in the second timing diagram 402 are identical, the first power consumption P1 is higher than the third power consumption P3. Therefore, during the image data input time T2, power supply efficiency may be improved in the case of FIG. 4 (the case of sequentially inputting image data to each of the plurality of pixels included in the display panel 130 during the second time T2 in the first time T1 and maintaining the image data input to each of the plurality of pixels) compared to the case of FIG. 5 (the case of continuously inputting image data to each of the plurality of pixels in sequence during the first time T1).

Figure 6:
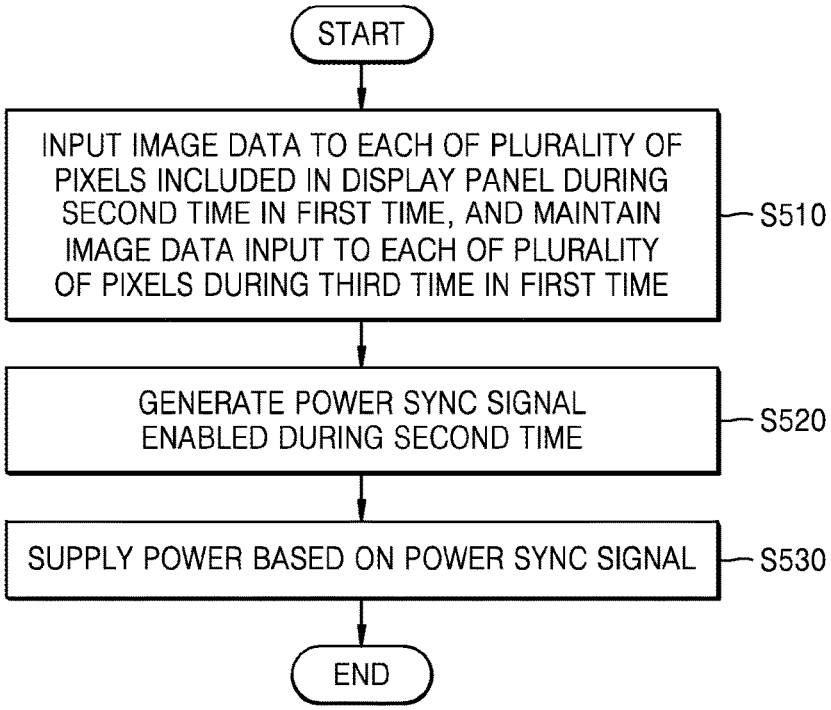
FIG. 6 is a flowchart illustrating an example operating method for the display device.

FIG. 6 is a flowchart illustrating an example operating method for a display device.

Referring to FIG. 6, the display device 100 according to an example embodiment may input image data to each of the plurality of pixels included in the display panel 130 during a second time within a first time, the first time being determined by a scanning frequency of the display panel 130, and may maintain the image data input to each of the plurality of pixels during a third time, the third time being all or part of the first time excluding the second time (S510).

The first time may be a time corresponding to a scanning period determined by the scanning frequency of the display panel 130. For example, when the scanning frequency of the display panel 130 is about 60 Hz, the first time corresponding to the scanning period may be about 16.6 ms. When the first time is about 16.6 ms, the second time may be about 4.4 ms which is shorter than the first time. Accordingly, when the scanning frequency of the display panel 130 is about 60 Hz, the display device 100 may be configured to provide control so that image data is input to each of the plurality of pixels included in the display panel 130 for about 4.4 ms. Using a TFT Q included in each of the plurality of pixels, the display device 100 may charge a holding capacitor included in each of the plurality of pixels, thereby inputting the image data to each of the plurality of pixels.

When the image data is input to each of the plurality of pixels, the display device 100 may be configured to provide control so that the image data input to each of the plurality of pixels is maintained during the third time which is all or part of the first time excluding the second time. For example, when the first time is about 16.6 ms and the second time is about 4.4 ms, the third time may be about 12.2 ms, and the display device 100 may maintain the image data input to each of all the plurality of pixels for about 12.2 ms.

The display device 100 may generate a power sync signal which is enabled for the second time in which the image data is input (S520).

The display device 100 may supply power to the display panel 130 and the display controller 120 based on the power sync signal (S530).

For example, the display device 100 may perform switching for supplying power when the power sync signal is enabled, and may stop the switching when the power sync signal is disabled. The voltage of the power increases up to a preset voltage when the display device 100 performs the switching, and gradually decreases when the display device 100 stops the switching.

As described above, when a display device according to an example embodiment is driven in a low power state, it is possible to improve power supply efficiency, and thus electric energy loss of the display device may be reduced.

The operating method for a display device according to an example embodiment may be provided in the form of program instructions executable by various computing devices, and recorded in a computer-readable recording medium. The computer-readable recording medium may include program instructions, data files, data structures, etc. solely or in combination. The program instructions recorded in the computer-readable recording medium may be particularly designed or configured for the present disclosure or may be known to and used by those of ordinary skill in the computer software art. Examples of the computer-readable recording medium include magnetic media, such as a hard disk, a floppy disk, and a magnetic tape, optical media, such as a compact disc read-only memory (CD-ROM) and a digital versatile disc (DVD), magneto-optical media, such as a floptical disk, and hardware devices, such as a read-only memory (ROM), a random-access memory (RAM), a flash memory, etc., configured to store and execute the program instructions. Examples of the program instructions include a high-level language code executable by a computer using an interpreter, etc. as well as a machine language code created by a compiler.

It should be understood that example embodiments described herein should be considered in a descriptive sense only and not for purposes of limitation. Descriptions of features or aspects within each example embodiment should typically be considered as available for other similar features or aspects in other example embodiments.

While one or more example embodiments have been described with reference to the figures, it will be understood by those of ordinary skill in the art that various changes in form and details may be made therein without departing from the spirit and scope as defined by the following claims.

What is claimed is:

1. A display device comprising:

a display panel including a plurality of pixels;

a display controller configured to input image data to the plurality of pixels during a second time within a first time, the first time being determined based on a scanning frequency of the display panel, and to maintain the image data input to the plurality of pixels during a third time, the third time being all or part of the first time excluding the second time; and a power supply configured to supply power to the display panel and the display controller, wherein the display controller is configured to generate a power sync signal enabled during the second time, and to enable the power sync signal prior to the second time during a data hold period, and the power supply is configured to supply the power based on the power sync signal, so that a source in a backlight of the display device is turned on based on the power sync signal near an end of the second time.

2. The display device of claim 1, wherein the power supply includes a switching mode power supply (SMPS).

3. The display device of claim 2, wherein the power supply is configured to perform switching to supply the power when the power sync signal is enabled, and to stop the switching when the power sync signal is disabled.

4. The display device of claim 3, wherein a voltage of the supplied power increases to a preset voltage when the switching is performed, and the voltage of the supplied power gradually decreases when the switching is stopped.

5. The display device of claim 1, further comprising a backlight unit configured to emit light to the display panel, wherein the backlight unit emits light when the power sync signal is enabled.

6. The display device of claim 1, wherein a first power consumption is consumed during the second time, and a second power consumption which is lower than the first power consumption is consumed during the third time.

7. The display device of claim 6, wherein each of the first power consumption and the second power consumption is lower than a highest power consumption of the display device.

8. A method for operating a display device, the method comprising:

inputting image data to each of a plurality of pixels included in a display panel during a second time within a first time, the first time being determined based on a scanning frequency of the display panel, and maintaining the image data input to each of the plurality of pixels during a third time, the third time being part or all of the first time excluding the second time;

generating a power sync signal enabled during the second time, wherein the power sync signal is enabled prior to the second time during a data hold period; and supplying power to the display panel and a display controller based on the power sync signal, and turning on a source in a backlight of the display device based on the power sync signal near an end of the second time.

9. The operating method of claim 8, wherein the supplying power to the display panel and the display controller based on the power sync signal comprises performing switching for supplying the power when the power sync signal is enabled, and stopping the switching when the power sync signal is disabled.

10. The operating method of claim 9, wherein a voltage of the supplied power increases to a preset voltage when the switching is performed, and the voltage of the supplied power gradually decreases when the switching is stopped.

11. The operating method of claim 8, further comprising emitting light to the display panel when the power sync signal is enabled.

12. The operating method of claim 8, further comprising consuming a first power consumption during the second time, and consuming a second power consumption which is lower than the first power consumption during the third time.

13. The operating method of claim 12, wherein the first power consumption and the second power consumption are lower than a highest power consumption of the display device.

14. A non-transitory computer-readable recording medium storing a program which, when executed, causes a computer to perform the operations of claim 8.

* * * * *